US011545767B2

(12) United States Patent
Ikeda et al.

(10) Patent No.: US 11,545,767 B2
(45) Date of Patent: Jan. 3, 2023

(54) TERMINAL BLOCK

(71) Applicant: OMRON Corporation, Kyoto (JP)

(72) Inventors: Tomokazu Ikeda, Yamaga (JP); Kiyokazu Matsunaga, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 18 days.

(21) Appl. No.: 17/413,167

(22) PCT Filed: Dec. 10, 2019

(86) PCT No.: PCT/JP2019/048240

§ 371 (c)(1),
(2) Date: Jun. 11, 2021

(87) PCT Pub. No.: WO2020/137508

PCT Pub. Date: Jul. 2, 2020

(65) Prior Publication Data

US 2022/0037812 A1 Feb. 3, 2022

(30) Foreign Application Priority Data

Dec. 26, 2018 (JP) ..... JP2018-243107

(51) Int. Cl.
*H01R 9/24* (2006.01)

(52) U.S. Cl.
CPC ..... *H01R 9/24* (2013.01)

(58) Field of Classification Search
CPC ..... H01R 9/24; H01R 9/2416; H01R 9/2675
See application file for complete search history.

(56) References Cited

U.S. PATENT DOCUMENTS 5,629,831 A 5/1997 Eggert et al.
6,392,319 B1 5/2002 Zebermann et al.
7,690,952 B2 * 4/2010 Koellmann ..... H01R 9/26 439/716
10,476,241 B2 * 11/2019 Azuma ..... H01R 9/2608
2002/0142671 A1 10/2002 Yano
(Continued)

FOREIGN PATENT DOCUMENTS

DE 102013022222 A1 6/2015
EP 3477779 A1 5/2019
(Continued)

OTHER PUBLICATIONS

International Search Report for International Application No. PCT/JP2019/048240; dated Jan. 28, 2020.
(Continued)

*Primary Examiner* — Vanessa Girardi
(74) *Attorney, Agent, or Firm* — Cantor Colburn LLP

(57) ABSTRACT

A terminal block includes a base, a support provided on the support, and a first terminal pair, a second terminal pair and a third terminal pair each supported by the support. A coupling line of the first electric wire is arranged along a first straight line, and a coupling line of the second electric wire is arranged along a second straight line. The base includes a support protrusion that extends to a coupling line of the third electric wire through between the coupling line of the first electric wire and the coupling line of the second electric wire and supports the coupling line of the third electric wire.

6 Claims, 4 Drawing Sheets

(56) References Cited

U.S. PATENT DOCUMENTS

| | | | |
|---|---|---|---|
| 2003/0220010 | A1 | 11/2003 | Otsuka et al. |
| 2009/0035983 | A1 | 2/2009 | Correll |
| 2009/0149074 | A1 | 6/2009 | Koellmann et al. |
| 2019/0123458 | A1 | 4/2019 | Azuma et al. |
| 2019/0288411 | A1 | 9/2019 | Masaki et al. |

FOREIGN PATENT DOCUMENTS

| | | | |
|---|---|---|---|
| JP | H08213077 | A | 8/1996 |
| JP | 2003346939 | A | 12/2003 |
| JP | 2019079653 | A | 5/2019 |
| JP | 2019160643 | A | 9/2019 |
| WO | 2018198497 | A1 | 11/2018 |
| WO | 2019049533 | A1 | 3/2019 |
| WO | 2019215953 | A1 | 11/2019 |

OTHER PUBLICATIONS

PCT Written Opinion of the International Searching Authority for International Application No. PCT/JP2019/048240; dated Jan. 28, 2020.

EPO Extended European Search Report for corresponding EP Application No. 19901944.9; dated Jun. 28, 2022.

* cited by examiner

TERMINAL BLOCK

CROSS REFERENCE TO RELATED APPLICATIONS

This is the U.S. national stage of application No. PCT/JP2019/048240, filed on Dec. 10, 2019. Priority under 35 U.S.C. § 119(a) and 35 U.S.C. § 365(b) is claimed from Japanese Application No. 2018-243107 filed Dec. 26, 2018, the disclosure of which is also incorporated herein by reference.

TECHNICAL FIELD

The present disclosure relates to, for example, a terminal block to which an electromagnetic relay can be connected.

BACKGROUND ART

In Patent Literature 1, a socket body, and a plurality of external connection terminals and a plurality of pressure contact terminals accommodated in the socket body are provided. Each external connection terminal is press-fitted with each terminal of a relay and connected to one corresponding pressure contact terminal via a lead wire.

CITATION LIST

Patent Literature

PTL 1: JP 2003-346939 A

SUMMARY OF INVENTION

Technical Problem

With a recent diversification of electromagnetic relays, socket apparatuses to which relays are connected are also required to cope with the diversification. For example, in the socket apparatus, the pressure contact terminals are arranged in two upper and lower stages in the height direction, but it is required to realize a socket apparatus in which pressure contact terminals are arranged in three or more upper and lower stages.

An object of the present disclosure is to provide a terminal block in which connection terminals are arranged in three or more stages.

Solution to Problem

A terminal block of an example of the present disclosure is a terminal block which includes:

an insulating base including an installation surface;

an insulating support provided on the installation surface; and a first terminal pair, a second terminal pair, and a third terminal pair each supported by the support, wherein each of the first terminal pair, the second terminal pair, and the third terminal pair includes a first connection terminal, and a second connection terminal, the first connection terminal and the second connection terminal of the first terminal pair are electrically connected to each other by a first electric wire, the first connection terminal and the second connection terminal of the second terminal pair are electrically connected to each other by a second electric wire, and the first connection terminal and the second connection terminal of the third terminal pair are electrically connected to each other by a third electric wire, the first connection terminal of the first terminal pair, the first connection terminal of the second terminal pair, the first connection terminal of the third terminal pair, the second connection terminal of the third terminal pair, the second connection terminal of the first terminal pair, and the second connection terminal of the second terminal pair are arranged in this order in a first direction along the installation surface, the first terminal pair, the second terminal pair, and the third terminal pair are arranged electrically independently of each other, the first connection terminal of the first terminal pair, the first connection terminal of the second terminal pair, and the first connection terminal of the third terminal pair are arranged in a stepwise manner so as to be farther from the installation surface in a second direction intersecting the installation surface from the first connection terminal of the first terminal pair toward the first connection terminal of the third terminal pair, each of the first electric wire, the second electric wire, and the third electric wire includes a first connection line extending in the second direction and connected to the first connection terminal, a second connection line extending in the second direction and connected to the second connection terminal, and a coupling line arranged in an electric wire passage portion provided between the base and the support in the second direction and extending in the first direction to couple the first connection line and the second connection line to each other, the coupling line of the first electric wire is arranged along a first straight line extending in the first direction, and the coupling line of the second electric wire is arranged along a second straight line arranged at an interval from the first straight line in a third direction intersecting the first direction and the second direction, the coupling line of the second electric wire is arranged between the coupling line of the first electric wire and the coupling line of the third electric wire, and the coupling line of the first electric wire is arranged closer to the installation surface than the coupling line of the third electric wire in the second direction, and the base includes a support protrusion that extends from the installation surface to the coupling line of the third electric wire through between the coupling line of the first electric wire and the coupling line of the second electric wire, and that supports the coupling line of the third electric wire.

Advantageous Effects of Invention

According to the terminal block, the first connection terminal of the first terminal pair, the first connection terminal of the second terminal pair, and the first connection terminal of the third terminal pair are arranged in a stepwise manner. The coupling line of the second electric wire that connects the first connection terminal and the second connection terminal of the second terminal pair is arranged between the coupling line of the first electric wire that connects the first connection terminal and the second connection terminal of the first terminal pair and the coupling line of the third electric wire that connects the first connection terminal and the second connection terminal of the third terminal pair. The coupling line of the first electric wire is arranged closer to the installation surface in the second direction than the coupling line of the third electric wire. The base includes the support protrusion that extends from the installation surface to the coupling line of the third electric wire through between the coupling line of the first electric wire and the coupling line of the second electric wire, and that supports the coupling line of the third electric wire. With such a configuration, it is possible to easily realize a terminal block in which the first connection terminals of the terminal pairs are arranged in three or more stages having different positions in the second direction.

DESCRIPTION OF EMBODIMENTS

Hereinafter, an example of the present disclosure will be described with reference to the accompanying drawings. In the following description, terms indicating specific directions or positions (for example, terms including "up," "down," "right," and "left") are used as necessary, but the use of these terms is to facilitate understanding of the present disclosure with reference to the drawings, and the technical scope of the present disclosure is not limited by the meanings of these terms. Further, the following description is merely exemplary in nature and is not intended to limit the present disclosure, an object for application, or a usage. Furthermore, the drawings are schematic, and ratios of dimensions and the like do not necessarily match actual ones.

Figure 1:
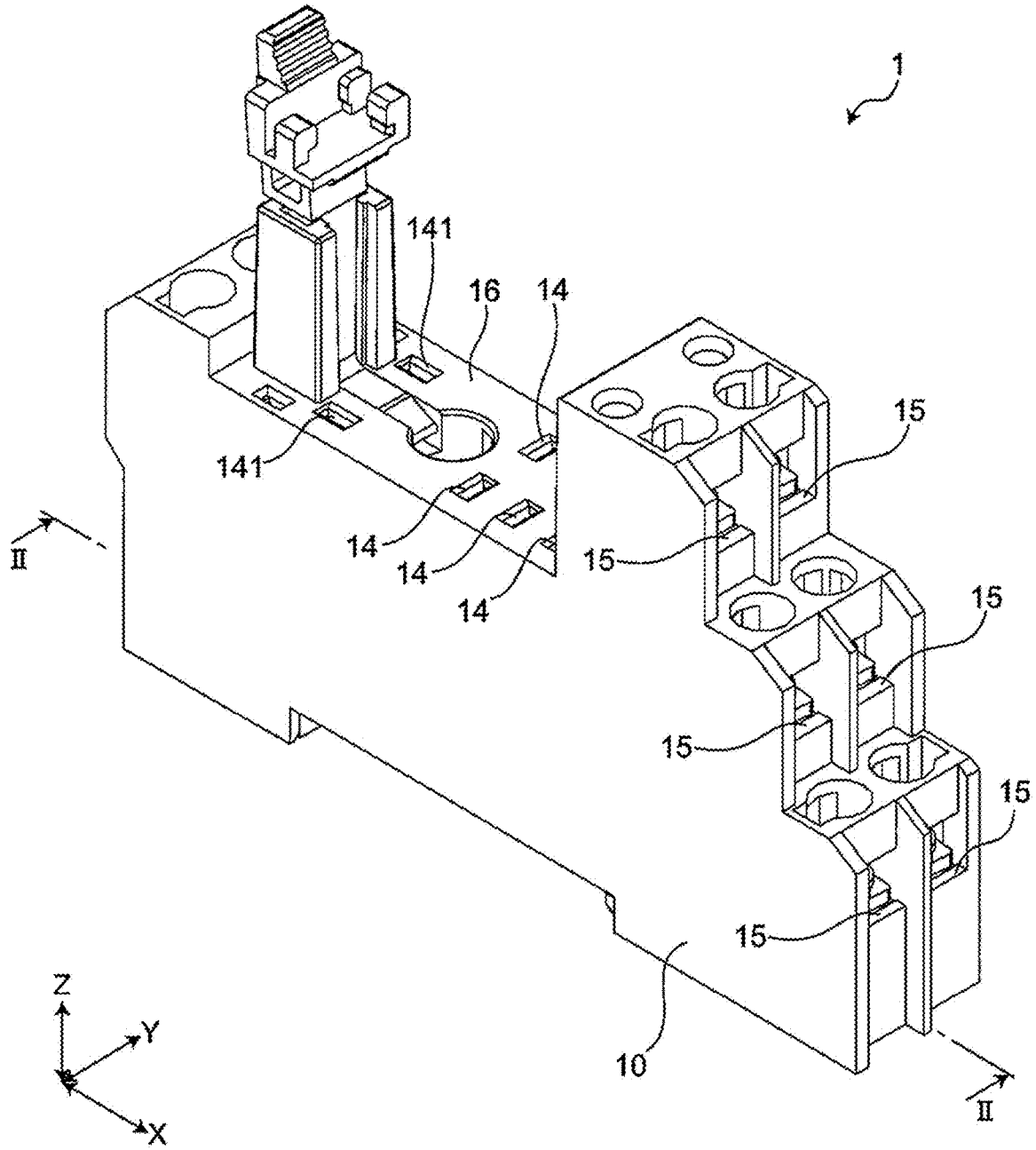
FIG. 1 is a perspective view showing a terminal block according to an embodiment of the present disclosure.
Figure 2:
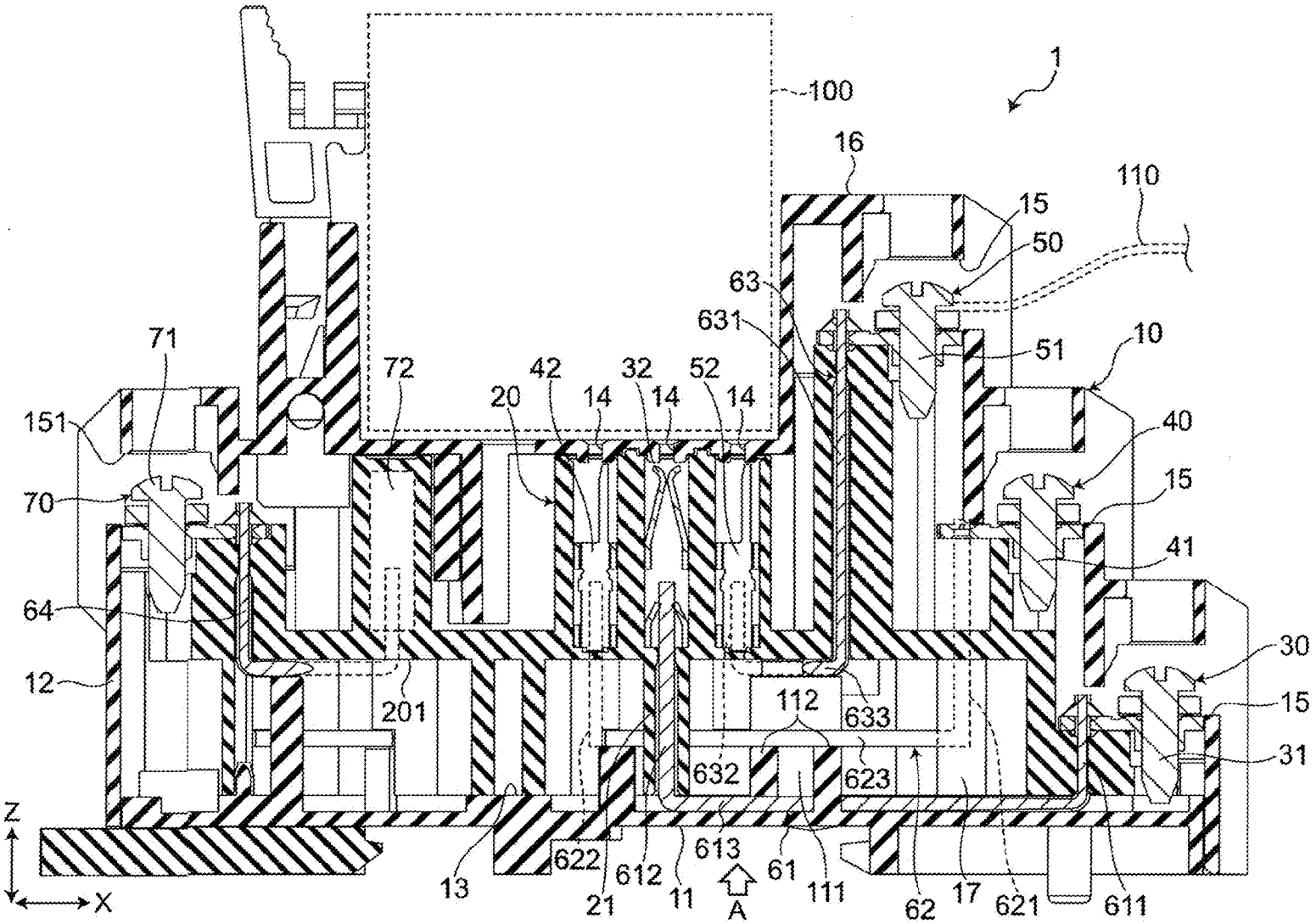
FIG. 2 is a cross-sectional view taken along line II-II of FIG. 1.

As shown in FIG. 1 and FIG. 2, a terminal block 1 according to an embodiment of the present disclosure includes an insulating housing 10 and an insulating support 20. The housing 10 has, for example, a substantially rectangular parallelepiped box shape, and the support 20 is accommodated therein. The support 20 supports a plurality of terminal pairs arranged electrically independently of each other. In the present embodiment, the terminal block 1 includes two sets of a first terminal pair 30, a second terminal pair 40, and a third terminal pair 50 as a plurality of terminal pairs. The two set of the first terminal pair 30, the second terminal pair 40, and the third terminal pair 50 are arranged symmetrically with respect to a center line CL (shown in FIG. 3) extending in the longitudinal direction X of the housing 10.

As shown in FIG. 2, the housing 10 includes a base 11 including an installation surface 13 and a cover 12 covering the installation surface 13.

The base 11 has a substantially rectangular plate shape, and the support 20 is provided on the installation surface 13 thereof. The base 11 includes a support protrusion 111 that supports a coupling line 633 of a third electric wire 63 described later. The support protrusion 111, which has a substantially rectangular plate shape, is arranged between a first connection terminal 31 and a second connection terminal 32, which will be described later, of the first terminal pair 30 in a longitudinal direction of the installation surface 13, and extends from the installation surface 13 to the coupling line 633 of the third electric wire 63 through between a coupling line 613 of a first electric wire 61 and a coupling line 623 of a second electric wire 62 (see FIG. 3). The support protrusion 111 is provided with two protruding portions 112 protruding from a plate surface toward the coupling line 623 of the second electric wire 62. Each of the protruding portions 112 extends in a direction orthogonal to the installation surface 13. Each of the protruding portions 112 is configured to be capable of supporting the coupling line 623 of the second electric wire 62 at an end portion farther from the installation surface 13 (see FIG. 3 and FIG. 4).

The cover 12 includes a plurality of first openings 14 for connecting terminals of an electromagnetic relay 100 and a plurality of second openings 15 for connecting an external wiring 110 to the respective terminal pairs 30, 40, and 50 inside the housing 10. In the present embodiment, six first openings 14 and six second openings 15 are provided on a connection surface 16 facing the installation surface 13 of the cover 12. Each of the first openings 14 is arranged substantially at a center of the connection surface 16 in a longitudinal direction thereof (that is, the longitudinal direction X of the housing 10), and two rows of three first openings 14 arranged along the longitudinal direction X of the connection surface 16 are provided at an interval in a lateral direction Y of the connection surface 16. Each of the second openings 15 is arranged at one end portion of the connection surface 16 in the longitudinal direction thereof, and similarly to the first openings 14, two rows of three second openings 15 arranged along the longitudinal direction X of the connection surface 16 are provided at an interval in the lateral direction Y of the connection surface 16.

As shown in FIG. 2, each of the terminal pairs 30, 40, and 50 include a first connection terminal 31, 41, and 51 and a second connection terminal 32, 42, and 52, respectively. Each of the first connection terminals 31, 41, and 51 is configured so that the external wiring 110 is connectable thereto, and is arranged near the second opening 15 of the cover 12. Each of the second connection terminals 32, 42, and 52 is configured so that the terminal of the electromagnetic relay 100 is connectable thereto, and is arranged near the first opening 14 of the cover 12.

The first connection terminal 31 and the second connection terminal 32 of the first terminal pair 30 are electrically connected to each other by the first electric wire 61. The first connection terminal 41 and the second connection terminal 42 of the second terminal pair 40 are electrically connected to each other by the second electric wire 62. The first connection terminal 51 and the second connection terminal 52 of the third terminal pair 50 are electrically connected to each other by the third electric wire 63.

As shown in FIG. 2, the first connection terminal 31, 41, and 51 and the second connection terminal 32, 42, and 52 of each of the terminal pairs 30, 40, and 50 are arranged in an order of the first connection terminal 31 of the first terminal pair 30, the first connection terminal 41 of the second terminal pair 40, the first connection terminal 51 of the third terminal pair 50, the second connection terminal 52 of the third terminal pair 50, the second connection terminal 32 of the first terminal pair 30, and the second connection terminal 42 of the second terminal pair 40 from one end to the other end of the housing 10 in the first direction X (that is, in the longitudinal direction of the housing 10) along the first direction X. The first connection terminal 31 of the first terminal pair 30, the first connection terminal 41 of the second terminal pair 40, and the first connection terminal 51 of the third terminal pair 50 are arranged in a stepwise manner so as to be farther from the installation surface 13 in the second direction Z (that is, the direction intersecting (for example, orthogonal to) the installation surface 13) from the first connection terminal 31 of the first terminal pair 30 toward the first connection terminal of the third terminal pair 50.

Each of the first electric wire 61, the second electric wire 62, and the third electric wire 63 has, for example, a substantially C-shaped rod shape, and includes, as shown in FIG. 2, a first connection line 611, 621, and 631 and a second connection line 612, 622, and 632 linearly extending in the second direction Z, and a coupling line 613, 623, and 633 linearly extending in the first direction X and coupling the first connection line and the second connection line, respectively. One end of the first connection line 611, 621, and 631 in the extending direction is connected to the first connection terminal 31, 41, and 51. The other end of the first connection line 611, 621, and 631 in the extending direction is connected to the coupling line 613, 623, and 633. One end of the second connection line 612, 622, and 632 in the extending direction is connected to the second connection terminal 32, 42, and 52. The other end of the second connection line 612, 622, and 632 in the extending direction is connected to the coupling line 613, 623, and 633.

The coupling line 613 of the first electric wire 61 is arranged along the installation surface 13 of the base 11, and the coupling line 633 of the third electric wire 63 is arranged along a bottom surface 201 of the support 20 constituting an electric wire passage portion 17 described later. That is, the coupling line 623 of the second electric wire 62 is arranged between the coupling line 613 of the first electric wire 61 and the coupling line 633 of the third electric wire 63, and the coupling line 613 of the first electric wire 61 is arranged closer to the installation surface 13 than the coupling line 633 of the third electric wire 63 in the second direction Z.

As shown in FIG. 2, the electric wire passage portion 17 is provided between the base 11 and the support 20 in the second direction Z inside the housing 10. The coupling lines 613, 623, and 633 of each of the electric wire 61, 62, and 63 are arranged in the electric wire passage portion 17.

Figure 3:
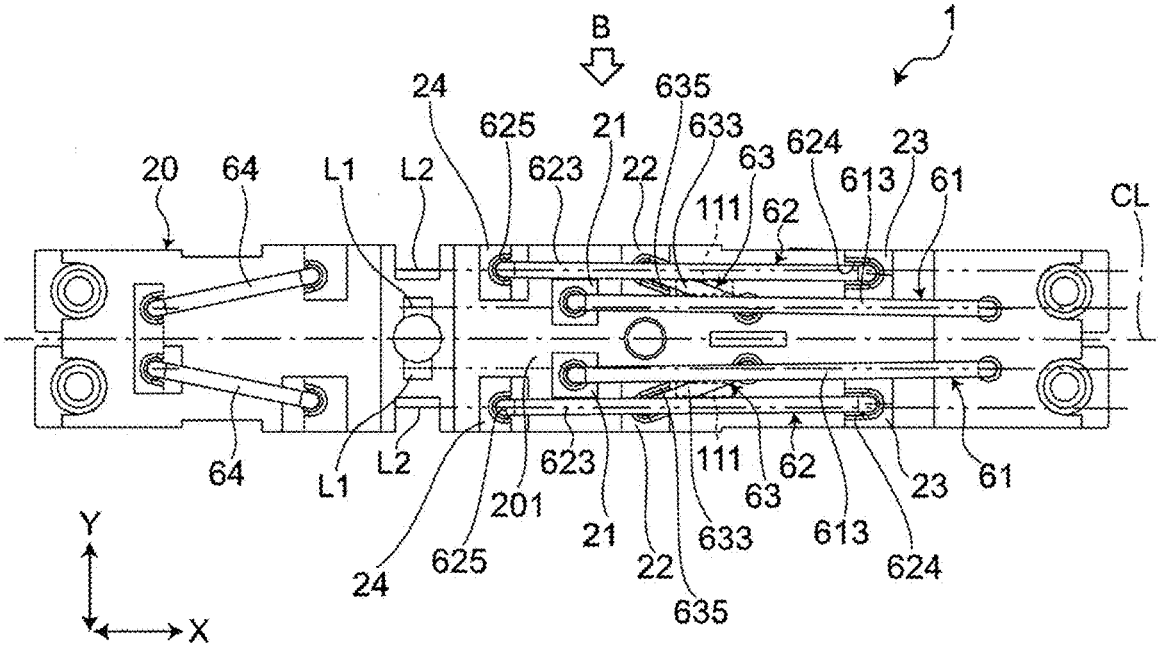
FIG. 3 is a bottom view of the terminal block of FIG. 1 in a state in which a housing is removed.

As shown in FIG. 3, the coupling line 613 of the first electric wire 61 is arranged along a first straight line L1 extending in the first direction X. The coupling line 623 of the second electric wire 62 is arranged along a second straight line L2 arranged at an interval from the first straight line L1 in the third direction Y intersecting (for example, orthogonal to) the first direction X and the second direction Z. In this manner, by arranging the coupling line 613 of the first electric wire 61 along the first straight line L1 and arranging the coupling line 623 of the second electric wire 62 along the second straight line L2, insulation between the coupling line 613 of the first electric wire 61 and the coupling line 623 of the second electric wire 62 is secured.

The coupling line 633 of the third electric wire 63 includes an end portion on a first connection line 631 side arranged on the first straight line L1 and an end portion on a second connection line 632 side arranged on the second straight line L2, and extends in a direction intersecting the first straight line L1 and the second straight line L2. In this manner, by arranging the coupling line 633 of the third electric wire 63 so as to intersect the first straight line L1 and the second straight line L2, the support area of the support protrusion 111 of the base 11 with respect to the third electric wire 63 can be increased. FIG. 3 is a bottom view of the support 20 supporting the terminal pairs 30, 40, and 50 as viewed from a direction of the arrow A of FIG. 2.

Figure 4:
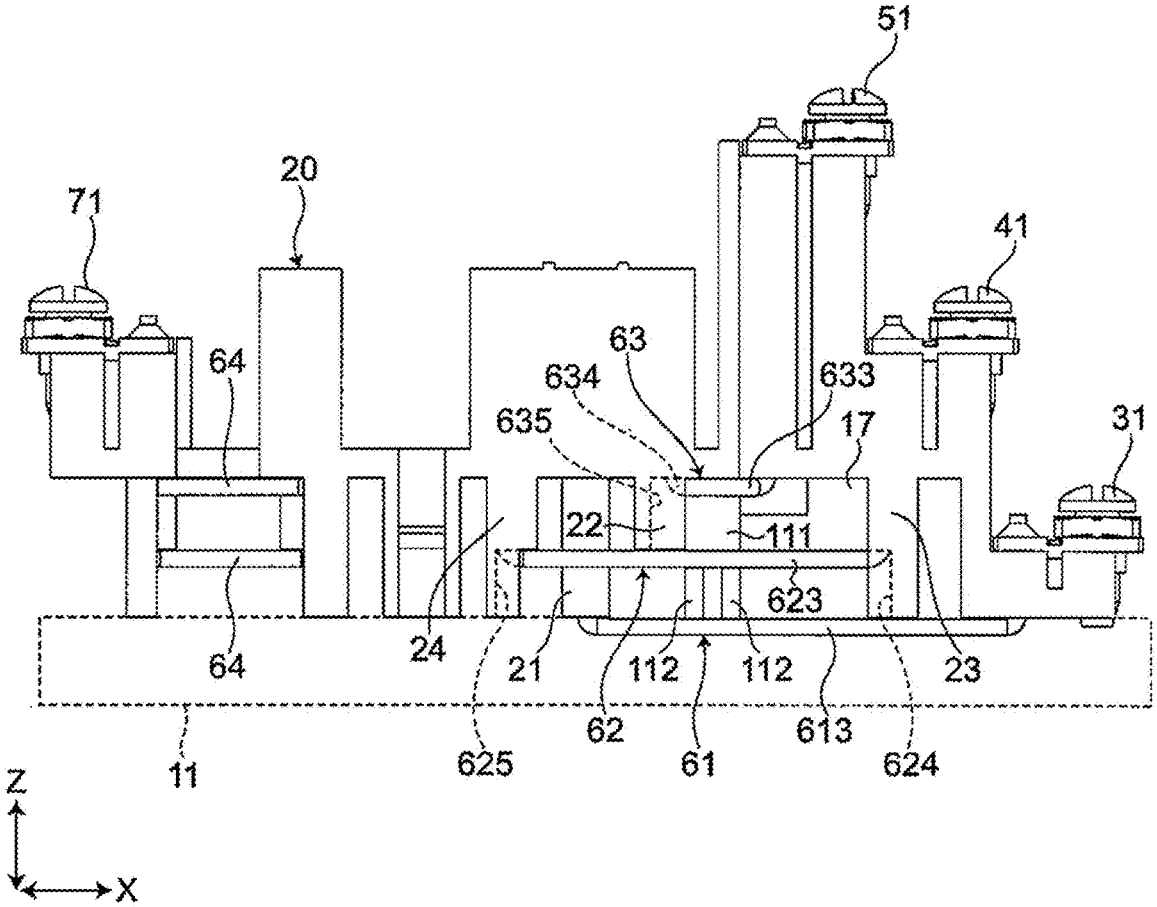
FIG. 4 is a side view of the terminal block of FIG. 1 in a state in which the housing is removed.

As shown in FIG. 4, the support 20 includes an insulating first cover wall portion 21 and an insulating second cover wall portion 22 which are arranged in the electric wire passage portion 17, the first cover wall portion 21 surrounding the second connection line 612 of the first electric wire 61 and the second cover wall portion 22 surrounding an end portion 634 of the coupling line 633 of the third electric wire 63 on the second connection line 632 side. FIG. 4 is a side view of the support 20 supporting the terminal pairs 30, 40, and 50 as viewed from a direction of the arrow B of FIG. 3.

The first cover wall portion 21 has a substantially rectangular parallelepiped shape, and extends from the bottom surface 201 of the support 20 forming the electric wire passage portion 17 toward the base 11 along the second direction Z to the coupling line 613 of the first electric wire 61. The first cover wall portion 21 ensures insulation between the second connection line 612 of the first electric wire 61 and the coupling line 623 of the second electric wire 62 while restricting a movement of the first electric wire 61.

The second cover wall portion 22 has a substantially rectangular parallelepiped shape, and extends from the bottom surface 201 of the support 20 toward the base 11 along the second direction Z to the coupling line 623 of the second electric wire 62. The second cover wall portion 22 includes a groove 635 extending in the second direction Z and opened toward the first connection line 631 of the third electric wire 63. The second cover wall portion 22 ensures insulation between the coupling line 623 of the second electric wire 62 and the coupling line 633 of the third electric wire 63 while restricting a movement of the third electric wire 63.

The support 20 includes an insulating third cover wall portion 23 and an insulating fourth cover wall portion 24 which are arranged in the electric wire passage portion 17, the third cover wall portion 23 surrounding the first connection line 621 of the second electric wire 62 and the fourth cover wall portion 24 surrounding the second connection line 622 of the second electric wire 62. Similarly to the first cover wall portion 21, each of the third cover wall portion 23 and the fourth cover wall portion 24 has a substantially rectangular parallelepiped shape, and extends from the bottom surface 201 of the support 20 toward the base 11 along the second direction Z to the coupling line 613 of the first electric wire 61. Each of the third cover wall portion 23 and the fourth cover wall portion 24 has a groove 624 and 625 extending in the second direction Z and opened so as to face each other in the first direction X, respectively. The third cover wall portion 23 and the fourth cover wall portion 24 secure insulation between the coupling line 613 of the first electric wire 61 and the coupling line 623 of the second electric wire 62 while restricting a movement of the second electric wire 62.

As shown in FIG. 2, the terminal block 1 includes a fourth terminal pair 70 in addition to the first terminal pair 30, the second terminal pair 40, and the third terminal pair 50. Similarly to the other terminal pairs 30, 40, and 50, the fourth terminal pair 70 includes a first connection terminal 71 and a second connection terminal 72 connected by a fourth electric wire 64. The connection surface 16 of the housing 10 is provided with an opening 151 for connecting the external wiring 110 to the first connection terminal 71 of the fourth electric wire 64 and an opening 141 (shown in FIG. 1) for connecting the terminal of the electromagnetic relay 100 to the second connection terminal 72 of the fourth electric wire 64.

According to the terminal block 1, the first connection terminal 31 of the first terminal pair 30, the first connection terminal 41 of the second terminal pair 40, and the first connection terminal 51 of the third terminal pair 50 are arranged in a stepwise manner so as to be farther from the installation surface 13 in the second direction Z from the first connection terminal 31 of the first terminal pair 30 toward the first connection terminal 51 of the third terminal pair 50. The coupling line 623 of the second electric wire 62 that connects the first connection terminal 41 and the second connection terminal 42 of the second terminal pair 40 is arranged between the coupling line 613 of the first electric wire 61 that connects the first connection terminal 31 and the second connection terminal 32 of the first terminal pair 30 and the coupling line 633 of the third electric wire 63 that connects the first connection terminal 51 and the second connection terminal 52 of the third terminal pair 50. The coupling line 613 of the first electric wire 61 is arranged closer to the installation surface 13 in the second direction than the coupling line 633 of the third electric wire 63. The base 11 includes the support protrusion 111 that extends from the installation surface 13 to the coupling line 633 of the third electric wire 63 through between the coupling line 613 of the first electric wire 61 and the coupling line 623 of the second electric wire 62, and that supports the coupling line 633 of the third electric wire 63. With such a configuration, it is possible to easily realize a terminal block in which the first connection terminals 31, 41, and 51 of the terminal pairs 30, 40, and 50 are arranged in three or more stages having different positions in the second direction Z.

The coupling line 633 of the third electric wire 63 includes the end portion 634 on the first connection line 631 side arranged on the first straight line L1 and the end portion on the second connection line 632 side arranged on the second straight line L2, and extends in the direction intersecting the first straight line L1 and the second straight line L2. With such a configuration, since the support area of the support protrusion 111 with respect to the coupling line 633 of the third electric wire 63 can be increased, the coupling line 633 of the third electric wire 63 can be more reliably positioned.

The support protrusion 111 includes the protruding portion 112 that supports the coupling line 623 of the second electric wire 62, in addition to the coupling line 633 of the third electric wire 63. With such a configuration, in addition to the coupling line 633 of the third electric wire 63, the coupling line 623 of the second electric wire 62 can be more reliably positioned.

The support 20 includes the insulating first cover wall portion 21 arranged in the electric wire passage portion 17, the first cover wall portion 21 surrounding the second connection line 612 of the first electric wire 61. With such a configuration, it is possible to secure insulation between the second connection line 612 of the first electric wire 61 and the coupling line 623 of the second electric wire 62 while restricting the movement of the first electric wire 61. As a result, for example, the terminal block 1 that can exhibit the insulation performance as designed can be easily realized.

The support 20 includes the insulating second cover wall portion 22 arranged in the electric wire passage portion 17, the second cover wall portion 22 surrounding the end portion of the coupling line 633 of the third electric wire 63 on the second connection line 632 side and extending to the coupling line 623 of the second electric wire 62 in the second direction Z. With such a configuration, it is possible to secure insulation between the coupling line 623 of the second electric wire 62 and the coupling line 633 of the third electric wire 63 while restricting the movement of the third electric wire 63.

Each of the electric wires 61, 62, and 63 has a rod shape. With such a configuration, the electric wires 61, 62, and 63 can be easily positioned, so that insulation between the electric wires 61, 62, and 63 can be easily secured.

For example, each of the electric wires 61, 62, 63, and 64 has a diameter of about 1.5 mm and is made of a single metal material. The cross-sectional shape of each of the electric wires 61, 62, 63, and 64 may be any of a circular shape, an elliptical shape, and a polygonal shape.

The coupling line 633 of the third electric wire 63 is not limited to extending in the direction intersecting the first straight line L1 and the second straight line L2, and may extend in parallel to either the first straight line L1 or the second straight line L2.

It is only necessary that the support protrusion 111 extends from the installation surface 13 of the base 11 to the coupling line 633 of the third electric wire 63 through between the coupling line 613 of the first electric wire 61 and the coupling line 623 of the second electric wire 62, and supports the coupling line 633 of the third electric wire 63. For example, the support protrusion 111 is not limited to a substantially rectangular plate shape, and may have a columnar shape or a prismatic shape. The protruding portions 112 may be omitted.

Only one of the first cover wall portion 21 and the second cover wall portion 22 may be provided, or both may be omitted.

Various embodiments of the present disclosure have been described above in detail with reference to the drawings. Finally, various aspects of the present disclosure will be described. In the following description, as an example, reference numerals are also added.

A terminal block 1 of a first aspect of the present disclosure is a terminal block which includes:

an insulating base 11 including an installation surface 13;

an insulating support 20 provided on the installation surface 13; and a first terminal pair 30, a second terminal pair 40, and a third terminal pair 50 each supported by the support 20, in which each of the first terminal pair 30, the second terminal pair 40, and the third terminal pair 50 includes a first connection terminal 31, 41, 51, and a second connection terminal 32, 42, 52, the first connection terminal 31 and the second connection terminal 32 of the first terminal pair 30 are electrically connected to each other by a first electric wire 61, the first connection terminal 41 and the second connection terminal 42 of the second terminal pair 40 are electrically connected to each other by a second electric wire 62, and the first connection terminal 51 and the second connection terminal 52 of the third terminal pair 50 are electrically connected to each other by a third electric wire 63, the first connection terminal 31 of the first terminal pair 30, the first connection terminal 41 of the second terminal pair 40, the first connection terminal 51 of the third terminal pair 50, the second connection terminal 52 of the third terminal pair 50, the second connection terminal 32 of the first terminal pair 30, and the second connection terminal 42 of the second terminal pair 40 are arranged in this order in a first direction X along the installation surface 13, and the first terminal pair 30, the second terminal pair 40, and the third terminal pair 50 are arranged electrically independently of each other, in which the first connection terminal 31 of the first terminal pair 30, the first connection terminal 41 of the second terminal pair 40, and the first connection terminal 51 of the third terminal pair 50 are arranged in a stepwise manner so as to be farther from the installation surface 13 in a second direction Z intersecting the installation surface 13 from the first connection terminal 31 of the first terminal pair 30 toward the first connection terminal 51 of the third terminal pair 50, each of the first electric wire 61, the second electric wire 62, and the third electric wire 63 includes a first connection line 611, 621, 631 extending in the second direction Z and connected to the first connection terminal 31, 41, 51, a second connection line 612, 622, 632 extending in the second direction Z and connected to the second connection terminal 32, 42, 52, and a coupling line 613, 623, 633 arranged in an electric wire passage portion 17 provided between the base 11 and the support 20 in the second direction Z and extending in the first direction X to couple the first connection line 611, 621, 631 and the second connection line 612, 622, 623 to each other, the coupling line 613 of the first electric wire 61 is arranged along a first straight line L1 extending in the first direction X, and the coupling line 623 of the second electric wire 62 is arranged along a second straight line L2 arranged at an interval from the first straight line L1 in a third direction Y intersecting the first direction X and the second direction Z, the coupling line 623 of the second electric wire 62 is arranged between the coupling line 613 of the first electric wire 61 and the coupling line 633 of the third electric wire 63, and the coupling line 613 of the first electric wire 61 is arranged closer to the installation surface 13 than the coupling line 633 of the third electric wire 63 in the second direction Z, and the base 11 includes a support protrusion 111 that extends from the installation surface 13 to the coupling line 633 of the third electric wire 63 through between the coupling line 613 of the first electric wire 61 and the coupling line 623 of the second electric wire 62, and that supports the coupling line 633 of the third electric wire 63.

According to the terminal block 1 of the first aspect, the first connection terminal 31 of the first terminal pair 30, the first connection terminal 41 of the second terminal pair 40, and the first connection terminal 51 of the third terminal pair 50 are arranged in a stepwise manner so as to be farther from the installation surface 13 in the second direction Z from the first connection terminal 31 of the first terminal pair 30 toward the first connection terminal 51 of the third terminal pair 50. The coupling line 623 of the second electric wire 62 that connects the first connection terminal 41 and the second connection terminal 42 of the second terminal pair 40 is arranged between the coupling line 613 of the first electric wire 61 that connects the first connection terminal 31 and the second connection terminal 32 of the first terminal pair 30 and the coupling line 633 of the third electric wire 63 that connects the first connection terminal 51 and the second connection terminal 52 of the third terminal pair 50. The coupling line 613 of the first electric wire 61 is arranged closer to the installation surface 13 in the second direction than the coupling line 633 of the third electric wire 63. The base 11 includes the support protrusion 111 that extend from the installation surface 13 to the coupling line 633 of the third electric wire 63 through between the coupling line 613 of the first electric wire 61 and the coupling line 623 of the second electric wire 62, and that supports the coupling line 633 of the third electric wire 63. With such a configuration, it is possible to easily realize a terminal block in which the first connection terminals 31, 41, and 51 of the terminal pairs 30, 40, and 50 are arranged in three or more stages having different positions in the second direction Z.

In the terminal block 1 of a second aspect of the present disclosure, the coupling line 633 of the third electric wire 63 includes an end portion 634 on a first connection line 631 side arranged on the first straight line L1 and an end portion on a second connection line 632 side arranged on the second straight line L2, and extends in a direction intersecting the first straight line L1 and the second straight line L2.

According to the terminal block 1 of the second aspect, since a support area of the support protrusion 111 with respect to the coupling line 633 of the third electric wire 63 can be increased, the coupling line 633 of the third electric wire 63 can be more reliably positioned.

In the terminal block 1 of a third aspect of the present disclosure, the support protrusion 111 includes a protruding portion 112 that supports the coupling line 623 of the second electric wire 62, in addition to the coupling line 633 of the third electric wire 63.

According to the terminal block 1 of the third aspect, in addition to the coupling line 633 of the third electric wire 63, the coupling line 623 of the second electric wire 62 can be more reliably positioned.

In the terminal block 1 of a fourth aspect of the present disclosure, the support 20 includes an insulating first cover wall portion 21 arranged in the electric wire passage portion 17, the first cover wall portion 21 surrounding the second connection line 612 of the first electric wire 61.

According to the terminal block 1 of the fourth aspect, it is possible to secure insulation between the second connection line 612 of the first electric wire 61 and the coupling line 623 of the second electric wire 62 while restricting a movement of the first electric wire 61.

In the terminal block 1 according to a fifth aspect of the present disclosure, the support 20 includes an insulating second cover wall portion 22 arranged in the electric wire passage portion 17, the second cover wall portion 22 surrounding the end portion of the coupling line 633 of the third electric wire 63 on the second connection line 632 side and extending to the coupling line 623 of the second electric wire 62 in the second direction Z.

According to the terminal block 1 of the fifth aspect, it is possible to secure insulation between the coupling line 623 of the second electric wire 62 and the coupling line 633 of the third electric wire 63 while restricting a movement of the third electric wire 63.

In the terminal block 1 of a sixth aspect of the present disclosure, each of the first electric wire 61, the second electric wire 62, and the third electric wire 63 has a rod shape.

According to the terminal block 1 of the sixth aspect, the electric wires 61, 62, and 63 can be easily positioned, so that insulation between the electric wires 61, 62, and 63 can be easily secured.

By appropriately combining any embodiments or modifications among the various embodiments or modifications, the effects of the respective embodiments or modifications can be achieved. In addition, combinations of embodiments, combinations of examples, or combinations of embodiments and examples are possible, and combinations of features in different embodiments or examples are also possible.

Although the present disclosure has been fully described in connection with preferred embodiments with reference to the accompanying drawings, various modifications and corrections will be apparent to those skilled in the art. Such modifications and corrections are to be understood as being included within the scope of the present disclosure as set forth in the appended claims.

INDUSTRIAL APPLICABILITY

The terminal block of the present disclosure can be used as, for example, a relay socket.

REFERENCE SIGNS LIST

1. terminal block
10. housing
11. base
111. support protrusion
112. protruding portion
12. cover
13. installation surface
14, 15, 141, 151. opening
16. connection surface
17. electric wire passage portion
20. support
201. bottom surface
21, 22, 23, 24. cover wall portion
30, 40, 50, 70. terminal pair
31, 41, 51, 71. first connection terminal
32, 42, 52, 72. second connection terminal
61, 62, 63, 64. electric wire
611, 621, 631. first connection line
612, 622, 632. second connection line
613, 623, 633. coupling line
634. end portion
624, 625, 635. groove
100. electromagnetic relay
110. external wiring

The invention claimed is:

1. A terminal block comprising:

an insulating base including an installation surface;

an insulating support provided on the installation surface; and a first terminal pair, a second terminal pair, and a third terminal pair each supported by the support, wherein each of the first terminal pair, the second terminal pair, and the third terminal pair includes a first connection terminal and a second connection terminal, the first connection terminal and the second connection terminal of the first terminal pair are electrically connected to each other by a first electric wire, the first connection terminal and the second connection terminal of the second terminal pair are electrically connected to each other by a second electric wire, and the first connection terminal and the second connection terminal of the third terminal pair are electrically connected to each other by a third electric wire, the first connection terminal of the first terminal pair, the first connection terminal of the second terminal pair, the first connection terminal of the third terminal pair, the second connection terminal of the third terminal pair, the second connection terminal of the first terminal pair, and the second connection terminal of the second terminal pair are arranged in this order in a first direction along the installation surface, the first terminal pair, the second terminal pair, and the third terminal pair are arranged electrically independently of each other, the first connection terminal of the first terminal pair, the first connection terminal of the second terminal pair, and the first connection terminal of the third terminal pair are arranged in a stepwise manner so as to be farther from the installation surface in a second direction intersecting the installation surface from the first connection terminal of the first terminal pair toward the first connection terminal of the third terminal pair, each of the first electric wire, the second electric wire, and the third electric wire includes a first connection line extending in the second direction and connected to the first connection terminal, a second connection line extending in the second direction and connected to the second connection terminal, and a coupling line arranged in an electric wire passage portion provided between the base and the support in the second direction and extending in the first direction to couple the first connection line and the second connection line to each other, the coupling line of the first electric wire is arranged along a first straight line extending in the first direction, and the coupling line of the second electric wire is arranged along a second straight line arranged at an interval from the first straight line in a third direction intersecting the first direction and the second direction, the coupling line of the second electric wire is arranged between the coupling line of the first electric wire and the coupling line of the third electric wire, and the coupling line of the first electric wire is arranged closer to the installation surface than the coupling line of the third electric wire in the second direction, and the base includes a support protrusion that extends from the installation surface to the coupling line of the third electric wire through between the coupling line of the first electric wire and the coupling line of the second electric wire, and that supports the coupling line of the third electric wire.

2. The terminal block according to claim 1, wherein the support includes an insulating first cover wall portion arranged in the electric wire passage portion, the first cover wall portion surrounding the second connection line of the first electric wire.

3. The terminal block according to claim 1, wherein the support includes an insulating second cover wall portion arranged in the electric wire passage portion, the second cover wall portion surrounding the end portion of the coupling line of the third electric wire on the second connection line side and extending to the coupling line of the second electric wire in the second direction.

4. The terminal block according to claim 1, wherein each of the first electric wire, the second electric wire, and the third electric wire has a rod shape.

5. The terminal block according to claim 1, wherein the coupling line of the third electric wire includes an end portion on a first connection line side arranged on the first straight line and an end portion on a second connection line side arranged on the second straight line, and extends in a direction intersecting the first straight line and the second straight line.

6. The terminal block according to claim 5, wherein the support protrusion includes a protruding portion that supports the coupling line of the second electric wire, in addition to the coupling line of the third electric wire.

* * * * *